US009969187B2

(12) United States Patent
De Roeck et al.

(10) Patent No.: US 9,969,187 B2
(45) Date of Patent: May 15, 2018

(54) BELT STEP CONVEYOR SYSTEM

(71) Applicant: AGFA GRAPHICS NV, Mortsel (BE)

(72) Inventors: Luc De Roeck, Mortsel (BE); Eric Piron, Mortsel (BE); Jan Zwijsen, Mortsel (BE)

(73) Assignee: AGFA NV, Mortsel (BE)

( * ) Notice: Subject to any disclaimer, the term of this patent is extended or adjusted under 35 U.S.C. 154(b) by 379 days.

(21) Appl. No.: 14/889,176

(22) PCT Filed: May 14, 2014

(86) PCT No.: PCT/EP2014/059819

§ 371 (c)(1),
(2) Date: Nov. 5, 2015

(87) PCT Pub. No.: WO2014/184226

PCT Pub. Date: Nov. 20, 2014

(65) Prior Publication Data

US 2016/0101633 A1 Apr. 14, 2016

(30) Foreign Application Priority Data

May 15, 2013 (EP) ..... 13167784

(51) Int. Cl.

| | |
|---|---|
| ***B41J 2/165*** | (2006.01) |
| ***B41J 11/00*** | (2006.01) |
| ***B65H 5/22*** | (2006.01) |

(52) U.S. Cl.

CPC ..... *B41J 11/007* (2013.01); *B65H 5/224* (2013.01); *B65H 2404/25* (2013.01); *B65H 2513/40* (2013.01); *B65H 2555/26* (2013.01)

(58) Field of Classification Search

None

See application file for complete search history.

(56) References Cited

U.S. PATENT DOCUMENTS

| | | | |
|---|---|---|---|
| 7,823,720 | B2 | 11/2010 | Tabata et al. |
| 2002/0044811 | A1 | 4/2002 | Regev et al. |
| 2007/0267274 | A1 | 11/2007 | Steffen et al. |

FOREIGN PATENT DOCUMENTS

| | | | |
|---|---|---|---|
| EP | 1 235 690 | B1 | 3/2004 |
| EP | 1 857 288 | A2 | 11/2007 |
| EP | 2 127 889 | A1 | 12/2009 |

OTHER PUBLICATIONS

Official Communication issued in International Patent Application No. PCT/EP2014/059819, dated Aug. 5, 2014.

*Primary Examiner* — Alejandro Valencia

(74) *Attorney, Agent, or Firm* — Keating and Bennett, LLP

(57) ABSTRACT

A belt step conveyor system includes a moving belt gripper mounted on a linear movement system to convey the conveyor belt rotating about a plurality of pulleys in successive distance movements while the moving belt gripper engages the conveying belt and the moving belt gripper is moved from a home position to an end position by linear movement system. The conveyor belt is stagnant by engaging a stagnating belt gripper while the moving belt gripper moves back to its home position, else the stagnating belt gripper releases the conveyor belt.

10 Claims, 5 Drawing Sheets

BELT STEP CONVEYOR SYSTEM

CROSS-REFERENCE TO RELATED APPLICATIONS

This application is a 371 National Stage Application of PCT/EP2014/059819, filed May 14, 2014. This application claims the benefit of European Application No. 13167784.1, filed May 15, 2013, which is incorporated by reference herein in its entirety.

BACKGROUND OF THE INVENTION

1. Field of the Invention

The invention relates to the transport of a load, for example an ink-receiver in an inkjet printer, with a conveyor belt system with high accurate successive distance movements to have the availability to manipulate or check the load on accurate positions between or during the successive distance movements.

2. Description of the Related Art

A state-of-the art step conveyor system as shown in FIG. 1, also called a step conveyor or stepper conveyor, is a piece of mechanical handling equipment that carries a load (4) by moving from a start location (40) to an end location (41) in successive distance movements also called discrete step increments. The direction movement from the start location (40) to the end location (41) is called the conveying direction (5). A step conveyor system is a conveyor system that allows quick and efficient transportation for a wide variety of materials such as a load (4). A step conveyor system may be used in many industries, including the automotive, agricultural, computer, electronic, food processing, aerospace, pharmaceutical, chemical, bottling and canning, print finishing, packaging and print industry.

If the step conveyor system, as shown in FIG. 1, comprises two or a plurality of pulleys (2) and a conveyor belt (1)—that rotates around them, it is called a belt conveyor system.

It is known in the state-of-the-art that one of the pulleys in a belt conveyor system is driven by an electric stepper motor to producing a torque to the pulley so by friction of the conveyor belt on the powered pulley the conveyor belt and the load is moved in a conveying direction. This is called a belt step conveyor system. A stepper motor is most commonly used for position control. The use of an electric stepper motor makes the transport of a load more controllable e.g. to change the speed of conveying and move the load on the conveyor belt in successive distance movements.

An example of the belt step conveyor belt system with an electric stepper motor is described for the media transport of a wide-format printer in EP 1235690 A (ENCAD INC)

To correct the flatness, resilience, oblique movement correction and/or the tension of the conveyor belt (1) several solutions are used in general belt conveyor systems which can also be used in a belt step conveyor system. An example is to make the pulleys slightly convex in order to keep the conveyor belt (1) centred. Another example of a general belt conveyor system comprising oblique movement correction mean by controlling an extra pulley is disclosed in U.S. Pat. No. 7,823,720 B (SEIKO EPSON CORP.).

However, still the slip occurring on the powered pulley (3) and the conveyor belt (1) remains difficult to control. This causes incorrect or less accurate positioning of a load on a conveyor belt.

There is still a need to provide a belt step conveyor system having a very exact positioning capability for handling different types and sizes of receiving loads.

US2007/0267274 (WERNER KAMMANN MASCHINENFABRIK) discloses a belt step conveyor system which doesn't guarantee a high accuracy of step increments.

SUMMARY OF THE INVENTION

Preferred embodiments of the present invention include a conveyor system and a conveying method comprising a conveyor belt (1) linked with two pulleys or a plurality of pulleys to carry a load (4) with successive distance movements in a conveying direction (5) by a drive system that comprises:

a driving mean to drive and control a first linear movement system (7);

a first belt gripper that has a first engaging mean to engage the conveyor belt (1) when the first belt gripper is moved by the first linear movement system (7) from a home position (8) to an end position (9) and that has a first releasing mean to release the conveyor belt (1) when the first belt gripper is moved by the first linear movement system (7) from the end position (9) to the home position (8);

a second belt gripper that has a second releasing mean to release the conveyor belt (1) when the first belt gripper is moved by the first linear movement system (7) from the home position (8) to the end position (9) and that has a second engaging mean to engage the conveyor belt (1) when the first belt gripper is moved by the first linear movement system (7) from the end position (9) to the home position (8).

The advantageous effect is that no slip occurs contrary to the belt step conveyor systems driven by a stepper motor to power a pulley (3). The exact positioning capabilities are also accurate and less tension force is needed on the conveyor belt to strengthen the resilience and tensioning of the conveyor belt.

Another advantage is the ease of implementation and use of the linear movement system in the embodiment of the belt step conveyor system to calculate the exact positioning of the load on the conveyor belt.

Another advantageous effect is that the engaging of the second belt gripper while the first belt gripper is returning to its end position ensures the stagnation of the conveyor belt and the load on the conveyor belt. This gives a more accurate positioning capability.

A preferred embodiment of the invention has a plurality of moving belt grippers to enlarge the force to carry the load on a conveyor belt from a start location to an end location. The force to carry the load on the conveyor belt from start location to end location can be divided by the linear movement systems of the plurality of moving belt grippers. The advantage is the need of linear movement systems with less linear force can be used, thereby obtaining a better control to drive the belt step conveyor system. A more preferred embodiment comprises a plurality of moving belt grippers mounted at each border, thus the left and the right border, of the conveyor belt. This allows to better control the straightness of the conveying path of the conveyor belt and a higher accuracy of position capabilities especially transverse to the conveying direction.

In a preferred embodiment, a belt gripper comprises a forcing mean to strengthen the resilience and/or the tension of the conveyor belt (1) while being engaged to the conveyor belt. Hence, a distance movement of the load on the conveyor belt is independent of the position of the carry-zone of the load.

The conveyor belt may comprise one or more layers wherein the thickness of the conveyor belt in the engage-zone is smaller than the thickness of the belt in the carry-zone. The conveyor belt may have a plurality of layers, preferably the conveyor belt comprises minimum one layer less in the engage-zone than in the carry-zone and/or the conveyor belt comprises a thinner layer in the engage-zone than the same layer in the carry-zone.

To lower the force while a belt gripper engages the conveyor belt, the engage-zone of the conveyor belt (1) has less layers and/or thinner layers than the carry zone of the conveyor belt conveyor belt preferably has at least one layer of a thermoplastic material and at least one layer of a woven fabric web characterized that the engage-zone of the conveyor belt (1) of the belt gripper has less layers and/or thinner layers than a carry-zone of the conveyor belt (1).

The use of an electro-magnet in a belt gripper is preferred because of the easy and fast control of the electro-magnet force. The belt gripper shall engage instantly the conveyor belt if the electro-magnet is powered on. The release of the conveyor belt is instantly done by powering off the electro-magnet. The instantly engaging and releasing from the belt gripper with an electro-magnet has the advantage of very high positioning capabilities. An electro magnet holder used as clamp for the conveyor belt is preferred.

To know the real distance movements and speed of the conveyor, the state-of-the art belt step conveyor systems use an encoder system wherein the encoder is circumferential positioned on one of the pulleys, also called an encoder pulley or otherwise on the conveyor belt, also called a conveyor belt encoder. The encoder pulley comprises a rotary encoder which is expensive and inaccurate, especially when slip is involved, and the conveyor belt encoder comprises a linear encoder which is difficult to attach to the conveyor belt. In a preferred embodiment the encoder system is mounted on the linear movement system (7), so that a smaller linear encoder is needed and the position of the moving belt gripper and distance of the successive distance movements of the load on the conveyor belt can be communicated.

A marking device, such as an inkjet printer, may comprise the embodiment of the belt step conveyor system wherein a pattern is marked on the surface of the load (4) while conveying the load (4). Preferably the marking device is a liquid inkjet printing device. An inkjet printer requires a very exact positioning. An example of the need of high positioning capability in a liquid inkjet printing device while transporting substrates from a home location to an end location is disclosed in EP 1721749 B (AGFA GRAPHICS).

Another preferred embodiment is that all the linked pulleys to the conveyor belt (1) are pulleys that are unpowered to drive the conveyor belt in a conveying direction. A more preferred embodiment is that all the linked pulleys to the conveyor belt (1) are idler pulleys.

Another preferred embodiment is that a pulley linked to the conveyor belt comprises an air cushion system to lower the slip of the conveyor belt on this pulley. This is also called an air cushion pulley.

DETAILED DESCRIPTION OF THE PREFERRED EMBODIMENTS

Belt Step Conveyor System

Figure 1:
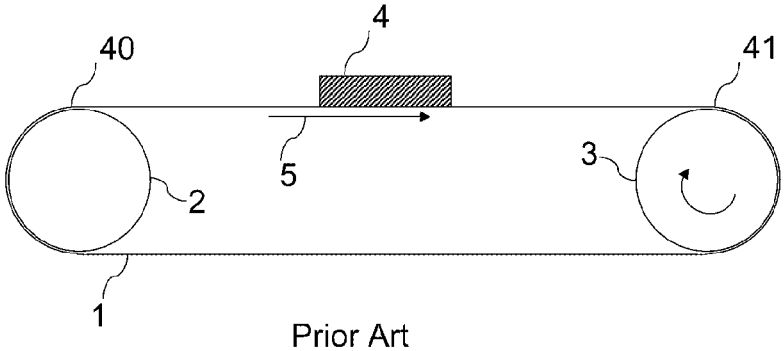
FIG. 1 illustrates a prior art conveyor belt system wherein one (3) of the plurality of pulleys (2) is powered to produce a torque on the pulley to move the conveyor belt (1) and to carry the load (4) on the conveyor belt in the conveying direction (5) from a start location (40) to an end location (41).
Figure 2:
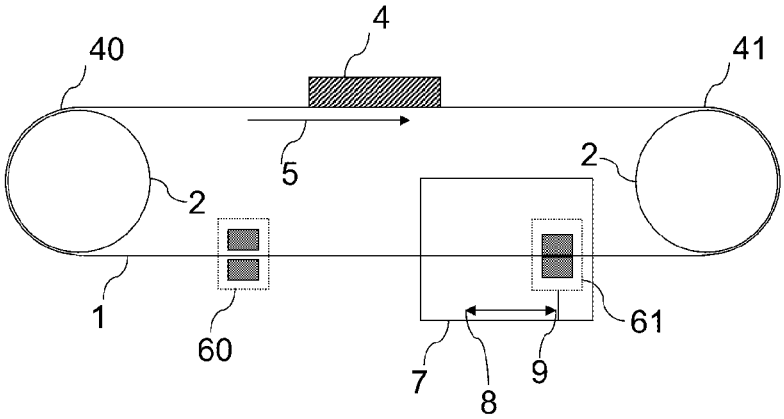
Prior Art FIG. 2
FIG. 2 illustrates an exemplary embodiment of a belt step conveyor system for moving the conveyor belt (1) and to carry the load (4) on the conveyor belt forward in the conveying direction (5) from a start location (40) to an end location (41) by successive distance movements. The drive system which is not shown in this figure moves a first belt gripper (61) by a linear movement system (7) to a home position (8) and an end position (9) while the first belt gripper (61) engages the conveyor belt (1) and the second belt gripper (60) released the conveyor belt (1).
Figure 3:
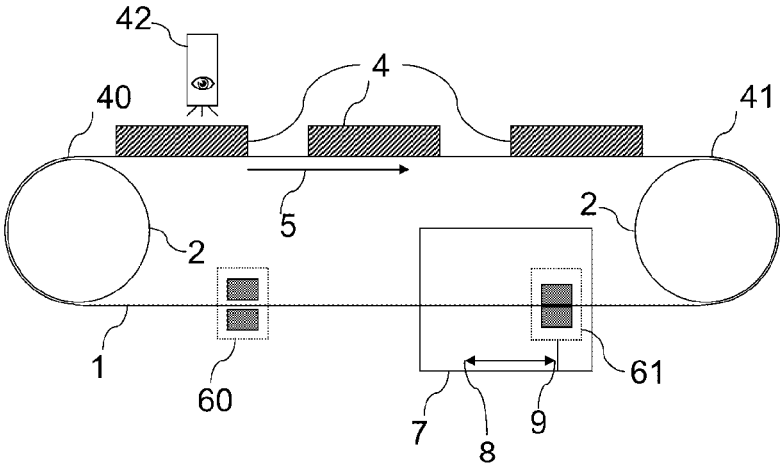
FIG. 3 illustrates an exemplary embodiment of a belt step conveyor system as in FIG. 2 by further including a detector system (42) to detect e.g. the position, height, length and/or width of the load (4) and/or other parameters that defines the nature of the load (4).
Figure 4:
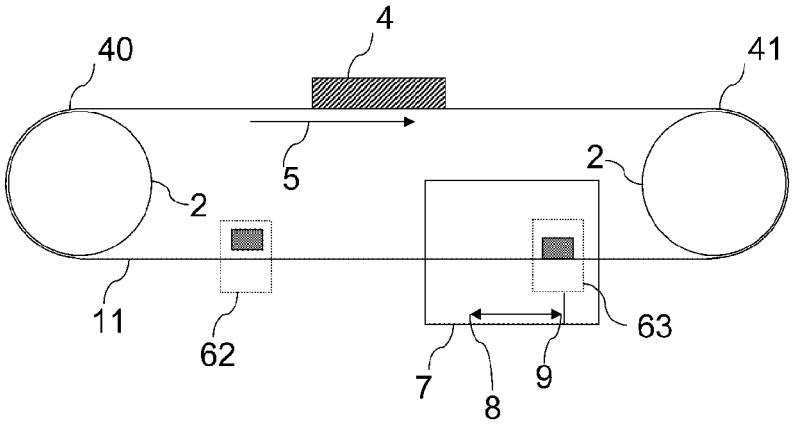
FIG. 4 illustrates an exemplary embodiment of the belt step conveyor system as in FIG. 2 wherein the belt grippers (62, 63) are electrical holding magnets which engage the magnetically attractable conveyor belt (11) when power-on of the engaging mean of the electrical holding mean (62, 63) occurs.
Figure 5:
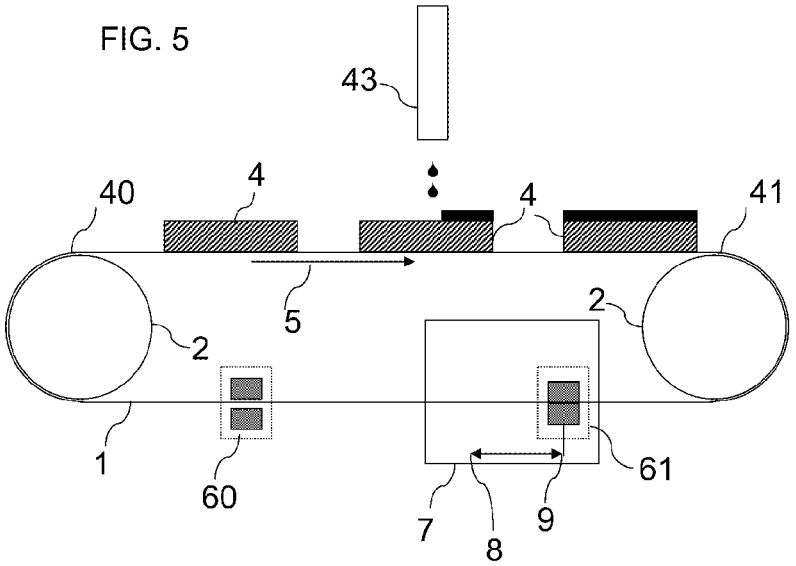
FIG. 5 illustrates an exemplary embodiment of the belt step conveyor system as in FIG. 2 wherein a liquid inkjet print device (43) with one more inkjet printheads, not visible in the figure, marks the surface on the load (4) by jetting ink to mark a pattern with the jetted ink on the surface on the load (4).
Figure 6:
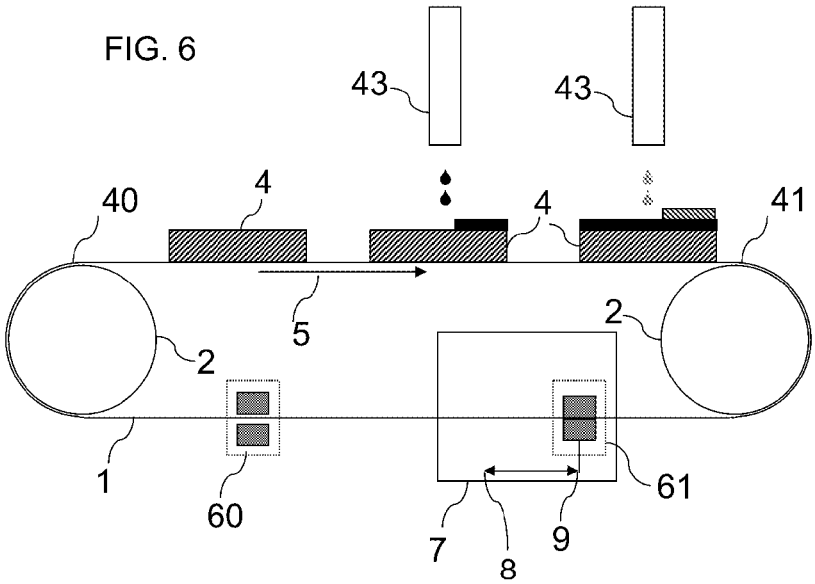
FIG. 6 illustrates an exemplary embodiment of the belt step conveyor system as in FIG. 2 wherein a plurality of liquid inkjet print devices (43) having one or more inkjet heads, not visible in the figure, marks the surface on the load (4) by jetting a first ink to mark a pattern with a jetted first ink on the surface on the load (4) and marking the already marked surface of the load (4) by jetting a second ink to mark a pattern with the jetted second ink on the marked surface on the load (4).
Figure 7:
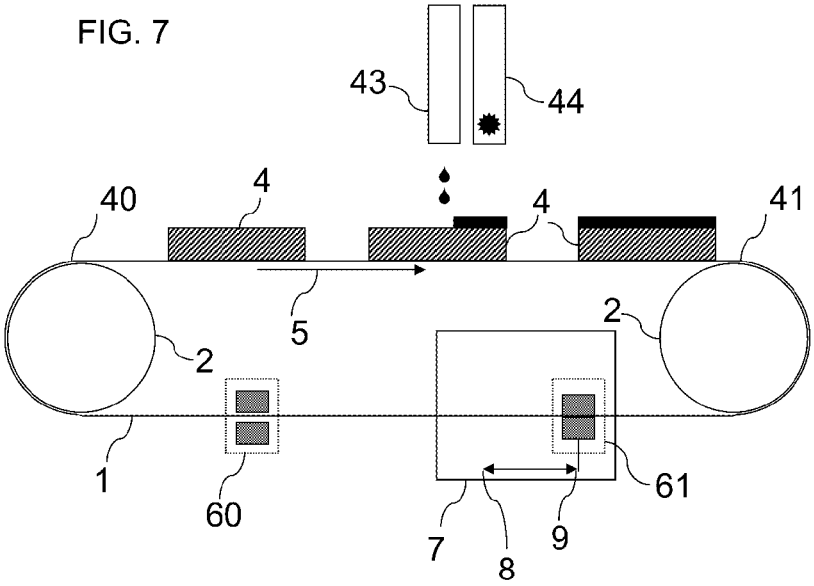
FIG. 7 illustrates an exemplary embodiment of the belt step conveyor system as in FIG. 5 wherein a UV source (44) is added to at least partially cure a jetted UV curable ink on the surface on the load (4)
Figure 8:
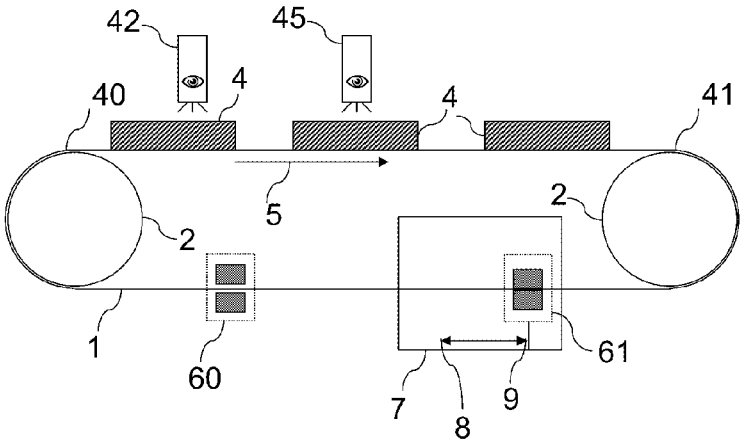
FIG. 8 illustrates an exemplary embodiment of the belt step conveyor system as in FIG. 3 wherein a system for imaging-based automatic inspection and analysis (45) of the load (4) is mounted.
Figure 9:
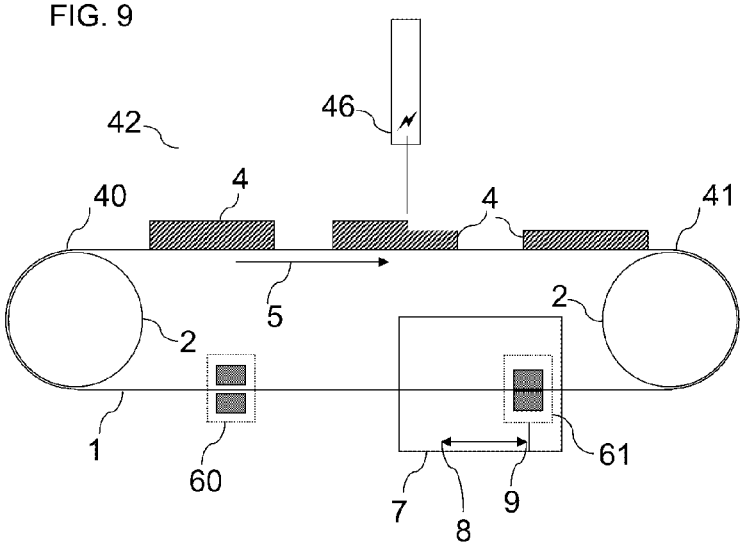
FIG. 9 illustrates an exemplary embodiment of the belt step conveyor system as in FIG. 2 wherein a laser system (46) with one or more beams of laser light marks the surface on the load (4) by removing part of the load (4) to mark a pattern on the surface of the load (4).

Preferred embodiments of the invention include a conveyor system and conveying method comprising a conveyor belt (1) linked with two pulleys or a plurality of pulleys to carry a load (4) with successive distance movements in a conveying direction (5) by a drive system that comprises:

a driving mean to drive and control a first linear movement system (7);

a first belt gripper that has a first engaging mean to engage the conveyor belt (1) when the first belt gripper is moved by the first linear movement system (7) from a home position (8) to an end position (9) and that has a first releasing mean to release the conveyor belt (1) when the first belt gripper is moved by the first linear movement system (7) from the end position to the home position;

a second belt gripper that has a second releasing mean to release the conveyor belt (1) when the first belt gripper is moved by the first linear movement system (7) from the home position (8) to the end position (9) and that has a second engaging mean to engage the conveyor belt (1) when the first belt gripper is moved by the first linear movement system (7) from the end position to the home position.

Air Cushion Pulley

One of the pulleys that are linked with the conveyor belt may comprise an air cushion system to lower the slip on the pulley and the conveyor belt. This is called an air cushion pulley. By providing air in an air chamber inside the pulley the air arrives through a plurality of holes out the surface of the perforated pulley so an air cushion effect on the conveyor belt (1) is achieved. The air flow rate through the plurality of holes may be controlled. The plurality of holes may be small in size, preferably from 0.3 to 2 mm in diameter, more preferably from 0.4 to 5 mm in diameter, most preferably from 0.5 to 10 mm in diameter. The plurality of holes may be spaced evenly apart on the surface of the air cushion pulley, preferably 3 mm to 50 mm apart, more preferably from 4 to 30 mm apart and most preferably from 5 to 15 mm apart to have an advantageous effect by lower the slip on the air cushion pulley and thus the stability of the conveyor belt. The belt is then carried on a film of air around the air cushion pulley which results in a contact-free passing of the conveyor belt over the pulley. Preferably the surface of the air cushion pulley is divided in logical zones, also called air cushion zones. An air cushion zone comprises a part of the plurality of holes. The air flow in each air cushion zone can be controlled separately e.g. by changing the air flows the conveying path of the conveyor belt (1) may be controlled. For each cushion zone the air cushion pulley may comprise an air chamber internally in the pulley.

Belt Step Conveyor Drive System

The drive system in the embodiment of the belt step conveyor system which moves the conveyor belt (1) in a conveying direction (5) comprises a linear movement system (7) that moves a first belt gripper from a home position to an end position of the linear movement system (7) and moves the first belt gripper back from the end position to the home position. While the first belt gripper moves from the home position to the end position, the first belt gripper has engaged the conveyor belt (1) in a first engage-zone on the conveyor belt (1) so the conveyor belt (1) moves in the conveying direction (5). While the first belt gripper moves from the end position to the home position the first belt gripper has released the conveyor belt (1). The repetition of the movement from home position to end position while the first belt gripper has engaged the conveyor belt (1) in the first engage-zone on the conveyor belt (1) and the movement from end position to home position while the first belt gripper has released the conveyor belt (1) results in a conveyor belt movement in the conveying direction (5) with successive distance movements. The repetition of these movements of the first belt gripper is also called the alternation movement step. The first belt gripper is also called a moving belt gripper. The speed of the moving belt gripper when it is moved from end position to home position may be faster than when it is moved from home position to end position. Preferably the speed of returning is at least one and half of the speed of moving from home position to end position.

Preferably the alternation movement step comprises an extra step after and/or during the movement from end position to home position when the first belt gripper has released the conveyor belt (1) being the checking, detecting and/or manipulating of the load (4). Preferably the manipulation of the load (4) is performed by marking the surface of the load (4) using a marking device. Preferably the step of detecting and/or checking of the load (4) is performed by a detector system (42) and more preferably an imaging-based automatic inspection and analysis of the load (4) and/or the surface of the load (4) for process control or robot guidance. Most preferably the checking of the load (4) is performed by measuring a colour or a plurality of colours on the surface of the load (4).

Preferably the embodiment of the belt step conveyor system comprises a second belt gripper to ensure the stagnation of the conveyor belt (1). While the first belt gripper has released the conveyor belt (1) and/or while the first belt gripper is moving from its end position to its home position, the second belt gripper in the drive system has engaged the conveyor belt (1) in a second engage-zone on the conveyor belt (1). This ensures the stagnation of the conveyor belt when it is released from the first belt gripper and this results in an accurate distance movement if the linear movement system (7) that moves the first belt gripper comprises an encoder system to control the position of the moving belt gripper. Preferably the first engage-zone and second engage-zone is the same. The second belt gripper is also called a stagnating belt gripper.

Preferably the drive system controls and drives a plurality of moving belt grippers by their engaging means and releasing means and by driving and controlling for each moving belt gripper a linear movement system (7) which moves the moving belt gripper between a home position and an end position. The repetition of the movement from the home position to the end position of the linear movement systems to move the plurality of moving belt grippers while they have engaged the belt (1) in their engage-zone on the conveyor belt (1) and the movement from end position to home position of the plurality of linear movement systems to move the plurality of moving belt grippers while the plurality of moving belt grippers has released the conveyor belt (1) results in a conveyor belt movement in the conveying direction (5) with successive distance movements.

Preferably the repetition of the movements of the plurality of moving belt grippers comprises an extra step after and/or during the movement from end position to home position of the linear movement systems to move the plurality of moving belt gripper while the moving belt grippers has released the conveyor belt (1) to check by a detector system (42), checking device and/or to manipulate the load (4) by a manipulation device. Preferably the manipulation of the load (4) is performed by marking the surface of the load (4) by a marking device. Preferably the checking of the load (4) is performed by providing an imaging-based automatic inspection and analysis of the load (4) for process control or robot guidance, more preferably the checking of the load (4) and/or the surface of the load (4) is performed by measuring a colour or a plurality of colours on the surface of the load (4).

The drive system in the embodiment of the belt step conveyor system controls and drives the engaging mean and/or releasing mean of each belt gripper. The drive system may also controls the distances between the home positions and end positions of each linear movement system (7) that moves the moving belt grippers to define each distance movement in the successive distance movements. The smallest distance movement on the belt step conveyor system is called the resolution of the belt step conveyor system. The resolution of the belt step conveyor system may depend on the distance between the home position and the end position of the linear movement system (7). The resolution of the belt step conveyor system is preferably between 0.01 micrometer and 10 micrometer, more preferably between 0.05 micrometer and 5 micrometer and most preferably between 0.1 micrometer and 2 micrometer. A smaller smallest distance movement in the belt step conveyor system means more exact the position capabilities of the belt step conveyor system.

Preferably the drive system comprises one or more stagnating belt grippers controls and drives one or more stagnating belt gripper by their engaging means and/or releasing means to ensure the stagnation of the conveyor belt (1) by engaging the conveyor belt (1) in their engage-zone on the conveyor belt (1) while the plurality of moving belt grippers has released the conveyor belt (1) and/or while they are moving from their end position to their home position of their linear movement system (7).

Preferably a stagnating belt gripper in the embodiment of the belt step conveyor system is a stationary belt gripper.

Preferably a belt gripper in the embodiment of the belt step conveyor system corrects the flatness, resilience, the straightness of the conveying path and/or the tension of the conveyor belt (1) by a forcing mean when it has engaged the conveyor belt (1) in its engage-zone on the conveyor belt (1). This forcing mean may be controlled by the drive system of the belt step conveyor system.

Preferably the drive system controls the flatness and/or oblique movement by correcting the distance of the home position and end position of the linear movement system (7) that moves a moving belt gripper. The control or correction of oblique movement is also called the control or correction of the straightness of the conveying path of the conveyor belt. The drive system of the belt step conveyor system in a preferred embodiment may also change the conveying direction (5) in the opposite direction so the conveyor belt (1) and the load (4) is moved back to the start location (40) in successive distance movements. The resolution of the belt step conveyor system may be different when the conveying direction (5) is changed. The changing of the conveying direction (5) may be done by swopping the home positions and end positions of the linear movement systems that moves the moving belt grippers. The drive system may also make the distance movements smaller or bigger by lowering or altering the distance between the home and the end position of the linear movement systems that moves the moving belt grippers. The drive system may also control the speed of conveying in the conveying direction (5) by lowering or altering the speed in the driving means of the linear movement systems that moves the moving belt grippers.

If the belt step conveyor system has a plurality of conveyor belts, the embodiment may have a plurality of drive systems to move each conveyor belt independently preferably with not rotating pulleys also called fixed shafts.

Load

The load (4) can be any material. The load (4) can be one or a plurality of regular or irregular shaped objects, large or small objects, light or heavy objects. The kind of load defines the material of the conveyor belt in order to reduce the stretch of the conveyor belt and to handle easier tension adjustments. Preferably the load (4) in the embodiment is a flat workpiece and more preferably flexible sheets (e.g. paper, transparency foils, adhesive PVC sheets or ink-receivers) with thickness down to 100 micrometers and preferably down to 50 micrometers. Most preferably rigid sheets (e.g. hard board, PVC, carton, wood or ink-receivers) are used preferably with a thickness up to 2 centimeters and more preferably up to 5 centimeters. More preferably the load (4) is flexible web material (e.g. paper, adhesive vinyl, fabrics and PVC, textile) as in a so called "roll-to-roll" configuration wherein the flexible web material is carried from roll to roll via the conveyor belt (1) or "roll-to-sheet" configuration wherein the flexible web material is carried from roll via the conveyor belt (1) to sheet after cutting the web material. Before the load (4) is carried by the conveyor belt (1) to move with successive distance movements in a conveying direction (5) by the drive system, the load (4) may have been carried and/or transported by another transportation mean such as a feeder or other conveyor system. After the load (4) is carried by the conveyor belt (1) to move with successive distance movements in the conveying direction (5) by the drive system, the load (4) may be carried and/or transported by another transportation mean such as a stacker or other conveyor system.

Detector System

Preferably the belt step conveyor system comprises a detector system (42) to detect the position of the load (4) that is carried on the conveyor belt (1) from the start location (40) to the end location (41). This detector system (42) may be mounted above the conveyor belt (1). The position, height, length and/or width of the load (4) and/or other parameters that defines the nature of the load (4) may be preferably communicated to the drive system in the belt step conveyor system, more preferably communicated to a checking device and/or manipulating device that checks and/or manipulate the load (4) while it is carried from the start location (40) to the end location (41) on the conveyor belt (1) and most preferably communicated to a marking device that marks the load (4) while it is carried from the start location (40) to the end location (41) on the conveyor belt (1). Preferably an edge detector is used. Also several detectors may be used.

It is possible to use camera systems for taking pictures or video images of the load (4) while carrying on the conveyor belt (1). Based upon these images it is possible, using e.g. image processing software to detect obstacles. The performance of these systems can be greatly enhanced using special lighting, e.g. oblique lighting of the area using special patterns, greatly enhancing the visibility and detection threshold of variations in topography of the load (4). Other systems using visual light may include e.g. a single light beam from a semiconductor laser, spanning the load (4) very close to the area to be guarded and which is detected by one or more photoelectric cells. More elaborate systems can use e.g. scanning light beams passing over or through the load (4). Especially when using a transparent load, a scanning light beam can be used which is detected at the other side of the load (4) by an elongated photoelectric cell or plurality of small photoelectric cells to form a elongated detector.

Instead of a single beam several beams along or/and above each other may be used or a small sheet-like laser bundle could be used. This can provide more information on the size or height of the load (4). To enhance the visibility of certain materials or problems which may be expected a preferred wavelength of the light can be used. When e.g. fluorescent foreign particles can be expected, it can be advantageous to use UV light to detect these objects.

Detection may even be done using CCD or camera systems enabling an even more detailed examination of the measured light intensities.

The evaluation may be based upon the edge, size, height, or colour of the load (4), but even more complicated evaluations can be made when using a video camera system. Even the form or outline of the load (4) may then be determined which could give information about the nature of the load (4).

Vacuum Table

Preferably the embodiment of the belt step conveyor system comprises a vacuum table (47) for holding the load (4) together with the conveyor belt (1) preferably after and/or during the movement from end position to home position while one of the moving belt grippers has released the conveyor belt (1) to check or manipulate the load (4) and more preferably during the carrying and movement of the load (4) from start location (40) to end location (41) wherein the force of holding the load (4) by the vacuum table (47) is smaller than the force of the drive system to move the conveyor belt (1). The vacuum table (47) may comprise a perforated table top containing a vacuum chamber, and a vacuum pump to keep the vacuum chamber below ambient pressure. The load (4) is carried by the conveyor belt (1) on the top of the vacuum chamber, and thus held down together with the conveyor belt (1) by the pressure differential between the vacuum chamber and the outside air. The vacuum pressure distributed along the transport belt by the vacuum chamber pulls the load (4) along the conveyor belt in the carry-zone of the load (4). Preferably the belt step conveyor system in the embodiment comprises a vacuum table (47) controller to control the pressure differential between the vacuum chamber and the outside air. The vacuum table (47) controller may be driven by the drive system in the embodiment of the belt step conveyor system to hold the load (4) together with the conveyor belt (1) preferably after and/or during the movement from end position to home position while one of the moving belt grippers has released the conveyor belt (1) to check or manipulate the load (4) and more preferably during the carrying and moving of the load (4) from start location (40) to end location (41).

To have a better holding of the load (4) together with the conveyor belt (1) by the vacuum table (47) the conveyor belt (1) preferably has a plurality of holes so that the air can be directed through the conveyor belt (1). The plurality of holes may be small in size, preferably from 0.3 to 10 mm in diameter, more preferably from 0.4 to 5 mm in diameter, most preferably from 0.5 to 2 mm in diameter and preferably spaced evenly apart on the conveyor belt (1) preferably 3 mm to 50 mm apart, more preferably from 4 to 30 mm apart and most preferably from 5 to 15 mm apart to enable the creation of uniform vacuum pressure that holds the load (4) together with the conveyor belt (1). An example of a general belt conveyor system comprising a vacuum table (47) to hold a substrate while printing and wherein the vacuum table (47) comprises pneumatic cleaning devices is disclosed in US 20100271425(A1) (XEROX CORPORATION).

Conveyor Belt

The conveyor belt (1) is made of at least one material such as a metal belt. Preferably the conveyor belt (1) includes magnetically attractable material such as a metal conveyor belt (1) and/or the conveyor belt (1) has one layer of a woven fabric web. More preferably the conveyor belt (1) has two or more layers of materials wherein an under layer provides linear strength and shape, also called the carcass and an upper layer called the cover or the support side. The carcass is preferably a woven fabric web and more preferably a woven fabric web of polyester, nylon or cotton. The material of the cover is preferably various rubber and more preferably plastic compounds and most preferably thermoplastic. But also other exotic materials for the cover can be used such as silicone or gum rubber when traction is essential. Preferably one of the engage-zones on the conveyor belt (1) for the belt grippers has less layers and/or thinner layer(s) than in one of the carry-zones to have a faster and better grip. An example of a multi-layered conveyor belt (1) for a general belt conveyor system wherein the cover having a gel coating is disclosed in US 20090098385 A1 (FORBO SIEBLING GMBH). Preferably the conveyor belt is a glass fabric or the carcass is glass fabric and more preferably the glass fabric has a coated layer on top with a thermoplastic polymer and most preferably the glass fabric has a coated layer on top with polytetrafluoroethylene also called PTFE.

The conveyor belt may also have a sticky cover which holds the load on the conveyor belt while it is carried from start location to end location. Said conveyor belt is also called a sticky conveyor belt. The advantageous effect of using a sticky conveyor belt allows an exact positioning of the load on the sticky conveyor belt. Another advantageous effect is that the load shall not be stretched and/or deformed while the load is carried from start location to end location. The adhesive on the cover is preferably activated by an infrared drier to make the conveyor belt sticky. The adhesive on the cover is more preferably a removable pressure sensitive adhesive.

Preferably the conveyor belt (1) is and endless conveyor belt. Examples and figures for manufacturing an endless multi-layered conveyor belt for a general belt conveyor system are disclosed in EP 1669635 B (FORBO SIEBLING GMBH).

Conveyor Belt Zones

The conveyor belt (1) is preferably divided in logical zones. An engage-zone of a moving belt gripper or stagnating belt gripper on a conveyor belt (1) indicates the possible engaging places that the moving belt gripper can use when it is engaging the conveyor belt (1) and this engage-zone is a logical zone in a circumferential direction of the conveyor belt (1). Preferably the engage-zone is positioned on the conveyor belt (1) at the boarder of the conveyor belt (1).

A carry-zone is a logical zone on the conveyor belt (1) wherein the load (4) can be carried to move the load (4) from the start location (40) to the end location (41) and this carry-zone is a logical zone in a circumferential direction of the conveyor belt (1). The conveyor belt (1) may have a plurality of carry-zones which may be partially overlap with each other when a plurality of loads are carried to move the load (4) from the start location (40) to the end location (41).

In a preferred embodiment a stagnating belt gripper holds the load on the conveying belt while the stagnating belt gripper is being engaged the conveying belt (1). So the engage-zone may partially or totally overlaps the carry-zone of the load.

Marking Device

Preferably a marking device comprises a belt step conveyor system as in the embodiment to mark the surface of a load (4) in the carry-zone while the load (4) is moved from the start location (40) to the end location (41) in successive distance movements. The marking of the surface of a load (4) is a specific manipulation of the load (4). The generic term marking device denotes any device adapted to make a pattern on a surface of a load (4), whether by impression, deformation or removal of matter from this surface. A pattern that is marked on the surface of a load is preferably an image. The marking of a surface needs a high precision of positioning the load (4) which is one of the advantageous effects of the embodiment of the belt step conveyor system. The surface of the load (4) may already be marked by another marking device. The pattern may have an achromatic or chromatic colour. Preferably the marking device in the embodiment is a print device, more preferably a toner-based print device or a liquid inkjet print device which may jet ink on an ink-receiver. To enhance the adhesion of the pattern on the load the marking device may comprise a drying system to dry the marked pattern on the load to have a better adhesion. Most preferably the marking device is a liquid inkjet print device with one or more inkjet printheads jetting UV curable ink to mark the surface of the load (4) which may be an ink-receiver.

If the marking device in the embodiment of the belt step conveyor belt (1) is a liquid inkjet print device with one or more inkjet printheads jetting UV curable ink to mark the surface of the load (4) a special UV source (44), as dryer system, is provided for curing the inks after printing. Spreading of a UV curable inkjet ink on an ink receiver can further be controlled by a partial curing or "pin curing" treatment wherein the ink droplet is "pinned", i.e. immobilized and no further spreading occurs. For example, WO 2004/002746 (INCA) discloses an inkjet printing method of printing an area of a substrate in a plurality of passes using curable ink, the method comprising depositing a first pass of ink on the area; partially curing ink deposited in the first pass; depositing a second pass of ink on the area; and fully curing the ink on the area.

A preferred configuration of UV source (44) is a mercury vapour lamp. Within a quartz glass tube containing e.g. charged mercury, energy is added, and the mercury is vaporized and ionized. As a result of the vaporization and ionization, the high-energy free-for-all of mercury atoms, ions, and free electrons results in excited states of many of the mercury atoms and ions. As they settle back down to their ground state, radiation is emitted. By controlling the pressure that exists in the lamp, the wavelength of the radiation that is emitted can be somewhat accurately controlled, the goal being of course to ensure that much of the radiation that is emitted falls in the ultraviolet portion of the spectrum, and at wavelengths that will be effective for UV curable ink curing. Another preferred UV source (44) is an UV-Light Emitting Diode.

The marking device may be used to create objects on the conveyor belt (1) through a sequential layering process, also called additive manufacturing or 3D printing. The objects that are manufactured additively can be used anywhere throughout the product life cycle, from pre-production (i.e. rapid prototyping) to full-scale production (i.e. rapid manufacturing), in addition to tooling applications and post-production customization. The position of a load (4), speed of the conveyor belt (1) and/or conveying direction (5) may be communicated with the marking device by the drive system in the embodiment of the belt step conveyor system to mark the surface of the load (4) correctly.

The marking device may be a valve-jet print device with a printhead that comprises a plurality of inline jets that are controlled by valves. The valves open and shut independently to produce streams of intermittent ink droplets. As the load (4) passes the printhead, these droplets make marks to the surface of the load (4) (e.g. characters and graphics based on a grid formation).

Preferably the marking device marks the surface of the load (4) while one or more stagnating belt grippers have engaged the conveyor belt (1) and more preferably the marking device marks the surface of the load (4) between the successive distance movements of the conveyor belt (1).

Preferably the belt step conveyor system comprises a plurality of marking devices to mark the surface of a load (4) in the carry-zone while the load (4) is moved from the start location (40) to the end location (41) in successive distance movements.

If the belt step conveyor system comprises a marking device (43), the belt grippers may be mounted on top of the belt step conveyor system to engage the belt gripper where a load is moved from home location to and location, preferably the one or plurality of moving belt grippers are mounted on top of the belt step conveyor system after the marking device can marking the load (4) and the one or plurality of stagnating belt grippers are mounted before the marking device can marking a load because the pulling the conveyor belt by the moving belt gripper has an advantageous effect on the stability of the conveyor belt (1) and the accurate positions of the load (4).

Linear Movement System

The linear movement system (7) in the embodiment of the belt step conveyor system is an electric motor that instead of producing a torque it produces a linear force along its length. Preferably the linear movement system (7) is a linear actuator that creates motion in a straight line, in contrast to the circular motion of a conventional electric motor and which typically operates by conversion of rotary motion into linear motion. The conversion is preferably made via a few simple types of mechanism e.g. screw (by rotating the actuator's nut, the screw shaft moves in a line), wheel and axle (a rotating wheel moves a cable, rack, chain or belt to produce linear motion) or cam (as a wheel-like cam rotates, its eccentric shape provides thrust at the base of a shaft).

Encoder System

Preferably the linear movement system (7) comprises an encoder system with a transducer sense position for use as a reference or active feedback to control the position of the moving belt gripper, also called an encoder. The advantage using an encoder system on a linear movement system (7) is to get a precise distance movement of the conveyor belt (1) with fault tolerance in the distance movements between 16 micrometer and 0.01 micrometer, more preferably between 8 micrometer and 0.01 micrometer and most preferably between 4 micrometer and 0.01 micrometer. Preferably the encoder system comprises a linear encoder which encodes linear position and/or orientation by a sensor and wherein the encoder system converts the encoded position into an analogue or digital signal. The encoders may have a digital resolution between 0.01 micrometer and 250 micrometer, more preferably a digital resolution between 0.01 and 50 micrometer and most preferably a digital resolution between 0.01 and 10 micrometer. The drive system may convert the analogue or digital signal of the encoded position in distances of the successive distance movements and the drive system may convert the home position and end position of a linear movement system (7) that moves a moving belt gripper. The drive system comprises a driving mean for this preferred linear movement system (7) to drive and control the position of the moving belt gripper preferably using the readings of the encoded positions in the encoder system. The smallest encoded position distance may define the resolution of the belt step conveyor system.

The linear encoder is preferably an optical linear encoder or a magnetic linear encoder. Examples of a magnetic linear encoder is described in EP 0388453 B (RENISHAW PLC) and EP 0514081 B (RENISHAW TRANSDUCER SYST).

In another preferred embodiment, the encoder system (7) comprises a sensor at the home position and a sensor at the end position of a linear movement system. The advantage using a plurality of sensors on a linear movement system (7) is to get a precise distance movement of the conveyor belt (1) with fault tolerance in the distance movements between 16 micrometer and 0.01 micrometer, more preferably between 8 micrometer and 0.01 micrometer and most preferably between 4 and 0.01 micrometer. Preferably the sensor system encodes the signals of the sensors and converts the encoded position into an analogue or digital signal. The drive system comprises a driving mean for this preferred linear movement system (7) to drive and control the position of the moving belt gripper preferably using the signals of the sensors at the home position and the end position. A more preferred embodiment is that the distance between the two sensors is changeable by comprising a movable mean that linear moves one of the sensors. The drive system may drive and control this movable. Another more preferred embodiment is that a third sensor is mounted on the linear movement system that may be used as sensor for another end position to give the embodiment the possibility to change the distance movement.

Belt Gripper

A forcing mean of a belt gripper (60, 61, 62, 63) in the embodiment of the belt step conveyor system is applying a force on the conveyor belt (1). This force may be a hydraulic force, friction, vacuum force, electromagnetic force and/or mechanical force. A belt gripper is preferably a gripper, a hydraulic clamp, a mechanical clamp or a suction cup.

A belt gripper comprises an engaging mean so the belt gripper engages the conveyor belt (1) in an engage-zone by a forcing. The engaging force may be less than 500 Newton, preferably less than 2000 Newton, and more preferably less than 4000 Newton. The required engaging force depends on the material of the conveyor belt in the engage-zone of the belt gripper, the amount of layers in the conveyor belt in the engage-zone of the belt gripper, the friction of the belt gripper on the conveyor belt, the friction of one of the plurality of pulleys on the conveyor belt, weight of a load (4) and/or force of the linear movement system (7) of the belt gripper if it is an moving belt gripper. But also other factors may influence the engaging force to engage the conveyor belt and/or to move the conveyor belt.

A belt gripper comprises a releasing mean so the belt gripper releases the conveyor belt (1). Preferably the engaging mean and releasing mean of a belt gripper are the same mean.

The drive system of the belt step conveyor system in the embodiment controls the engaging mean and releasing mean of the belt gripper.

Preferably a belt gripper and more preferably an engaging mean of a belt gripper may have a forcing mean to strengthen the resilience and/or to control the straightness of the conveying path and/or control the tension of the conveyor belt (1). The forcing mean may comprise a spring that shall be compressed when the belt gripper has engaged the conveyor belt (1).

Figure 12:
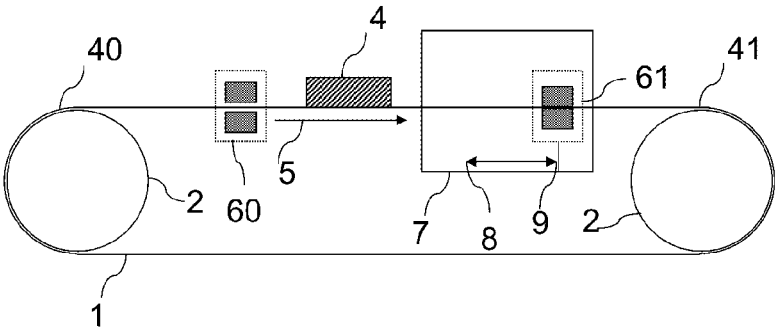
FIG. 12 illustrates an exemplary embodiment of the belt step conveyor system as in FIG. 2. The first belt gripper (61) and second belt gripper (60) are mounted on top of the belt step conveyor system.

A belt gripper preferably engages and/or releases the conveyor belt (1) in their engage-zone at the top of the belt step conveyor system as shown in FIG. 12 so the tension to prevent the elongation of the conveyor belt while the load (4) is carried is guaranteed. Hence more accurate positions of the load between the successive distances can be achieved.

The engage-zone is preferably positioned at the edge of the conveyor belt (1) and more preferably positioned at both edges of the conveyor belt if more movable belt grippers are mounted in the embodiment.

Electrical Holding Magnet

A belt gripper in the embodiment of the belt step conveyor system may be an electrical holding magnet which comprises an electromagnet. The engaging mean and releasing mean of the electrical holding are than the same mean. If the conveyor belt (1) is magnetically attractable than a power-on of the engaging mean of the electrical holding magnet, the electrical holding magnet engages the magnetically attractable conveyor belt (11) in an engage-zone and a power-off of the engaging mean of the electrical holding magnet, the electrical holding magnet releases the magnetisable conveyor belt (1). Preferably the magnetically attractable conveyor provides an optimum holding force if it is engaged with the electrical holding magnet and low magnetic remanence if it is released from the electrical holding magnet.

If the conveyor belt (1) may not be engaged by the electrical holding magnet in the magnetic field of the electrical holding magnet when it is power-on (e.g. non-magnetisable conveyor belt) preferably the electrical holding magnet comprises a magnetically attractable element, also called an armature so that a power-on of the engaging mean of the electrical holding magnet, the electrical holding magnet engages the armature and the conveyor belt (1) which is between the armature and the electrical holding magnet and so that a power-off of the engaging mean of the electrical holding magnet, the electrical holding magnet releases the armature and thus also releases the conveyor belt (1). An electrical holding magnet comprising an armature is also called an electromagnetic clutch. The armature comprises preferably a self-aligning mounting to provide an optimum holding force if it is engaged with the electrical holding magnet and/or a low magnetic remanence if it is released from the electrical holding magnet.

Alternative Embodiment

Figure 10:
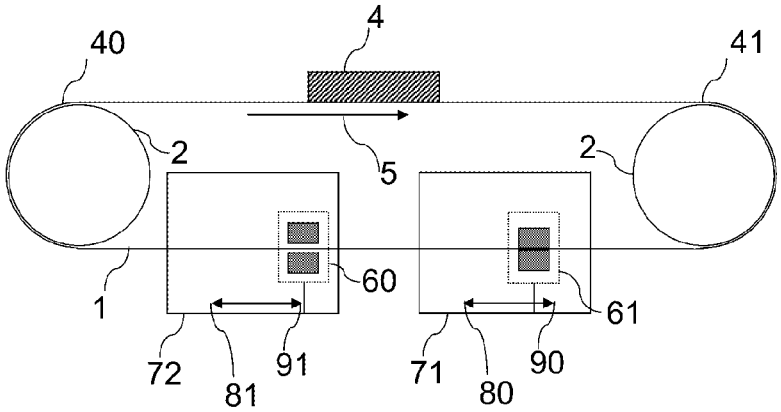
FIG. 10 illustrates an exemplary embodiment of a belt step conveyor system for moving the conveyor belt (1) and to carry the load (4) on the conveyor belt forward in the conveying direction (5) from a start location (40) to an end location (41) by successive distance movements. The drive system which is not shown in this figure moves a first belt gripper (61) by a linear movement system (71) to a home position (80) and an end position (90) while a first belt gripper (61) engages the conveyor belt (1) and a second belt gripper (60) released the conveyor belt (1) and is positioned in the home position (81) of its linear movement system (72).
Figure 11:
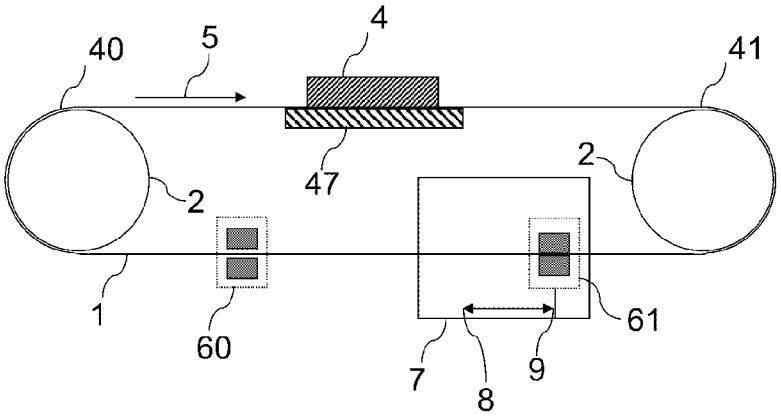
FIG. 11 illustrates an exemplary embodiment of a belt step conveyor system for moving the conveyor belt (1) and to carry the load (4) on the conveyor belt in the conveying direction (5) from a start location (40) to an end location (41) by successive distance movements. The drive system which is not shown in this figure moves a first belt gripper (61) by a linear movement system (7) to a home position (8) and an end position (9) while the first belt gripper (61) engages the conveyor belt (1) and the second belt gripper (60) released the conveyor belt (1). During the carrying of the load (4) from the start location (40) to the end location (41) the load (4) is held down the conveyor belt (1) and a vacuum table (47) by the pressure differential between the vacuum chamber, not in the figure, and the outside air. The vacuum table (47) controller, not in this figure, controls the pressure differential.

Preferably the drive system in the embodiment of the belt step conveyor system (FIG. 10) controls and drives a first set of one or more moving belt grippers and a second set of one or more moving belt grippers by their engaging means and releasing means and by driving and controlling for each moving belt gripper a linear movement system (71, 72) which moves the moving belt gripper between a home position and an end position. The repetition of the following successive steps occurs:

a) the movement from the home position to the end position of the linear movement systems to move the first set of one or more moving belt grippers while they have engaged the conveyor belt (1) in their engage-zone on the conveyor belt (1) and the second set of one or more moving belt grippers have released the conveyor belt (1);

b) the movement from end position to home position of the plurality of linear movement systems to move the first set of one or more moving belt grippers while they have released the conveyor belt (1) while the second set of one or more moving belt grippers have engaged the conveyor belt (1) in their engage-zone on the conveyor belt (1);

c) the movement from the home position to the end position of the linear movement systems to move the second set of one or more moving belt grippers while they have engaged the conveyor belt (1) in their engage-zone on the conveyor belt (1) and the first set of one or more moving belt grippers have released the conveyor belt (1); and d) the movement from end position to home position of the plurality of linear movement systems to move the second set of one or more moving belt grippers while they have released the conveyor belt (1) while the first set of one or more moving belt grippers have engaged the conveyor belt (1) in their engage-zone on the conveyor belt (1) results in a conveyor belt movement in the conveying direction (5) with successive distance movements and with a higher speed because the time of returning to the home position of a set of plurality of moving belt grippers is compensated by the movement of the other set of plurality of moving belt grippers.

INDUSTRIAL APPLICABILITY

The belt step conveyor system can be used in many industries, including the automotive, agricultural, computer, electronic, food processing, aerospace, pharmaceutical, chemical, bottling and canning, print finishing, packaging and print industry to transport a load from a home location to an end location. The load may be manipulated while it is conveyed.

REFERENCE SIGNS LIST

1: a conveyor belt
2: a pulley
3: a powered pulley
4: a load (4)
5: conveying direction
7: a linear movement system
8: home position
9: end position
11: magnetically attractable conveyor belt
40: start location
41: end location
42: detector system
43: a liquid inkjet print device
44: UV source
45: a system for imaging-based automatic inspection and analysis
46: a laser system
47: vacuum table
60: a belt gripper which has released the conveyor belt
61: a belt gripper which has engaged the conveyor belt
62: a electrical magnet holder as belt gripper which has released the magnetically attractable conveyor belt
63: a electrical magnet holder as belt gripper which has engaged the magnetically attractable conveyor belt
71: a linear movement system
72: a linear movement system
80: home position
81: home position
90: end position
91: end position

The invention claimed is:

1. A liquid inkjet print device comprising:

a conveyor system including a conveyor belt and two or more pulleys to carry a substrate by performing successive distance movements in a conveying direction; and a drive system including:

a first linear movement system;

a first belt gripper that engages the conveyor belt when the first belt gripper is moved by the first linear movement system from a home position to an end position and that releases the conveyor belt when the first belt gripper is moved by the first linear movement system from the end position to the home position; and a second belt gripper that releases the conveyor belt when the first belt gripper is moved by the first linear movement system from the home position to the end position and that engages the conveyor belt when the first belt gripper is moved by the first linear movement system from the end position to the home position; wherein the two or more pulleys do not drive the conveyor belt; and the first linear movement system includes an encoder that controls movement of the first belt gripper and the successive distance movements of the substrate on the conveyor belt, and a fault tolerance of the encoder is between 16 micrometers and 0.01 micrometer.

2. The liquid inkjet print device according to claim 1, wherein the first belt gripper and/or the second belt gripper includes an electromagnet.

3. The liquid inkjet print device according to claim 1, wherein the first belt gripper and/or second belt gripper applies a gripper force to strengthen a resilience of the conveyor belt, to control a straightness of a conveying path of the conveyor belt, and/or to control a tension of the conveyor belt.

4. The liquid inkjet print device according to claim 1, wherein the conveyor belt includes an engaging zone where the first belt gripper and/or the second belt gripper engages the conveyor belt and a carry zone that carries the substrate, and a thickness of the conveyor belt is smaller in the engaging zone than in the carry zone.

5. The liquid inkjet print device according to claim 1, wherein at least one of the two or more pulleys is an air cushion pulley.

6. A liquid jetting printing method comprising the steps of:

conveying a substrate with a conveyor belt including two or more pulleys to carry the substrate by performing successive distance movements in a conveying direction by repeating the following steps:

engaging a first belt gripper with the conveyor belt and releasing a second belt gripper from the conveyor belt;

moving the first belt gripper by driving a first linear movement system from a home position to an end position;

engaging the second belt gripper with the conveyor belt and releasing the first belt gripper from the conveyor belt; and moving the first belt gripper by driving the first linear movement system from the end position to the home position; wherein the two or more pulleys do not drive the conveyor belt; and the steps of moving the first belt gripper and conveying the substrate by performing successive distance movements includes using an encoder, and a fault tolerance of the encoder is between 16 micrometers and 0.01 micrometer.

7. The liquid jetting printing method according to claim 6, wherein the step of engaging the first belt gripper and/or the step of engaging the second belt gripper includes powering-on an electromagnet.

8. The liquid jetting printing method to claim 6, wherein the step of engaging the first belt gripper and/or the step of engaging the second belt gripper includes strengthening a resilience of the conveyor belt, controlling a straightness of a conveying path of the conveyor belt, and/or controlling a tension of the conveyor belt with the first belt gripper and/or the second belt gripper.

9. The liquid jetting printing method according to claim 6, wherein at least one of the two or more pulleys lowers a slip of the conveyor belt by flowing air through a plurality of holes in a surface of the at least one of the two or more pulleys.

10. The liquid jetting printing method according to claim 6, wherein a digital resolution of the encoder is between 0.1 micrometer and 50 micrometers.

* * * * *